United States Patent [19]

Smith

[11] Patent Number: 4,950,187

[45] Date of Patent: Aug. 21, 1990

[54] TROLLING MOTOR FOOT CONTROL APPARATUS

[76] Inventor: Rodney L. Smith, 9608 Robin NE., Albuequerque, N. Mex. 87112

[21] Appl. No.: 355,322

[22] Filed: May 22, 1989

[51] Int. Cl.[5] ..... B63H 21/26; B63H 25/02

[52] U.S. Cl. ..... 440/7; 440/59

[58] Field of Search ..... 114/144 E; 440/7, 59, 440/58, 60

[56] References Cited

U.S. PATENT DOCUMENTS

| | | | |
|---|---|---|---|
| 2,804,838 | 9/1957 | Mosser | 440/7 |
| 2,877,733 | 3/1959 | Harris | 440/7 |
| 2,885,990 | 5/1959 | Hawthorne | 440/59 |
| 3,121,415 | 2/1964 | Anderson et al. | 440/59 |
| 3,283,738 | 11/1966 | Nelsen | 440/59 |

FOREIGN PATENT DOCUMENTS

| | | | |
|---|---|---|---|
| 2441540 | 7/1980 | France | 440/59 |

*Primary Examiner*—Sherman Basinger
*Attorney, Agent, or Firm*—Leon Gilden

[57] ABSTRACT

A trolling motor foot control apparatus is set forth to provide steering to a trolling motor by use of an associated reversing electric motor oriented orthogonally relative to the downwardly depending steering shaft of the trolling motor. The electric motor is provided with an axially extending worm gear cooperative with an internally threaded collar pivotally mounted relative to the trolling motor. A remote treadle control controls rotation of the electric motor to accordingly control desired rotation of the worm gear and accordingly control pivoting of the trolling motor for steerage purposes.

8 Claims, 4 Drawing Sheets

TROLLING MOTOR FOOT CONTROL APPARATUS

BACKGROUND OF THE INVENTION

1. Field of the Invention

The field of invention relates to remote controlled trolling motor steering mechanisms, and more particularly pertains to a new and improved trolling motor foot control apparatus for providing remote steerage control of an associated trolling motor.

2. Description of the Prior Art

The prior art has provided for mechanisms to remotely actuate the orientation of a trolling motor with respect to an associated boat. Trolling motors of the prior art have typically been of a relatively complex and cumbersome organization to effect manipiulation of an associated trolling motor. For example, U.S. Pat. No. 3,598,947 provides for a remotely controlled trolling motor organization that is integrally formed about the downwardly depending steering shaft of the trolling motor and includes a housing fixedly surrounding the associated trolling motor shaft to enable rotation of the shaft by an orthogonally extending gear formed about the shaft.

U.S. Pat. No. 2,804,838 to Moser sets forth a trolling motor control unit that is again fixedly secured about the shaft of a trolling motor utilizing a driving gear associated with the associated motor in cooperation with a ring gear secured with the steerage shaft of the trolling motor to effect rotation of the shaft and provide orientation of the trolling motor relative to an associated boat.

U.S. Pat. No. 4,515,567 to Wilson sets forth a controlled trolling motor assembly utilizing a linkage arrangement to effect rotation of the trolling motor's steering shaft, as well as providing for an on/off switch within the pedal to activate the associated electrical trolling motor.

U.S. Pat. No. 4,527,983 to Booth sets forth a control for a trolling motor to effect steerage of an associated boat wherein rotation of a plate on a remotely mounted control unit effects steerage control of the associated trolling motor while a downward depressing of the plate completes electrical circuit to energize the associated trolling motor.

U.S. Pat. No. 4,587,388 to Cavin sets forth a switching device for enabling foot control of an associated trolling motor and to provide for selective energizing of an associated electrical trolling motor.

As such, it may be appreciated that there is continuing needs for a new and improved trolling motor foot control which addresses both the problems of compactness of organization and effectiveness in use, and in this respect, the present invention substantially fulfills this need.

SUMMARY OF THE INVENTION

In view of the foregoing disadvantages inherent in the known types of remotely mounted trolling motor control arrangements now present in the prior art, the present invention provides a trolling motor for control apparatus wherein the same enables remote steerage control of an associated trolling motor for use in combination with a boat. As such, the general purpose of the present invention, which will be described subsequently in greater detail, is to provide a new and improved trolling motor foot control apparatus which has all the advantages of the prior art remotely mounted trolling motor control apparatus and none of the disadvantages.

To attain this, the present invention comprises a trolling motor foot control apparatus wherein the same provides a remotely mounted treadle control pivotally mounted on a support plate to selectively provide electrical association of spaced contacts on either side of the support plate to control the direction of rotation of an associated electrical control motor wherein the electrical control motor is formed with an axially coextending worm gear. The worm gear cooperates with a pivotally mounted and internally threaded collar secured between spaced support plates of a bracket that is secured to a downwardly depending steerage shaft of a trolling motor.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art appreciate that the conception, upon which the disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms of phraseology, to determine quickly from a cursory inspection the nature and essence of the techanical disclosure of the application. The abstract is neither intended to define the invention of the application, which is measured by the claims, nor is it intended to be limiting as to the scope of the invention in any way.

It is therefore an object of the present invention to provide a new and improved trolling motor foot control apparatus which has all the advantages of the prior art remote control apparatus and none of the disadvantages.

It is another object of the present invention to provide a new and improved trolling motor foot control apparatus which may be easily and efficiently manufactured and marketed.

It is a further object of the present invention to provide a new and improved trolling motor foot control apparatus which is of a durable and reliable construction.

An even further object of the present invention is to provide a new and improved trolling motor foot control apparatus which is susceptible of a low cost of manufacture with regard to both materials and labor, and which accordingly is then susceptible of low prices of sale to the consuming public, thereby making such trolling motor foot control apparatus economically available to the buying public.

Still yet another object of the present invention is to provide a new and improved trolling motor foot control apparatus which provides in the apparatuses and methods of the prior art some of the advantages thereof, while simultaneously overcoming some of the disadvantages normally associated therewith.

Still another object of the present invention is to provide a new and improved trolling motor foot control apparatus wherein the same enables remotely controlled steerage of an associated trolling motor by pivotment of a treadle plate to determine rotational direction of a steerage motor.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes referencce to the annexed drawings wherein.

DESCRIPTION OF THE PREFERRED EMBODIMENT

Figure 1:
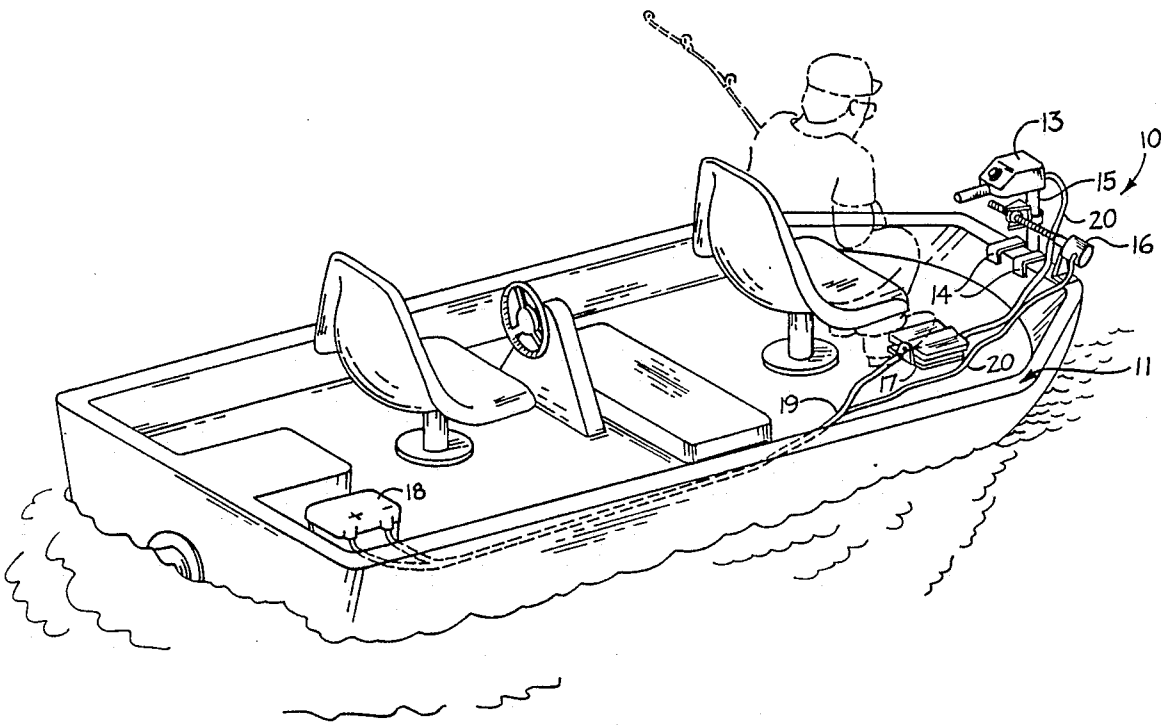
FIG. 1 is an isometric illustration of the instant invention secured to an associated trolling motor and boat.

With reference now to the drawings, and in particular to FIGS. 1 to 7 thereof, a new and improved trolling motor foot control apparatus embodying the principles and concepts of the present invention and generally designated by the reference numeral 10 will be described.

More specifically, it will be noted that the trolling motor foot control apparatus 10 essentially comprises the apparatus operably associated with a trolling motor 13 utilizing a plurality of conventional trolling motor clamps to secure the trolling motor to the bow of a boat 11, as illustrated in FIG. 1, or the stern, as is conventional. The trolling motor 13 is provided with a downwardly depending trolling motor steering shaft 15 orthogonally oriented relative to the boat 11.

The invention further comprises a reversing direct current electrical steerage motor 16 mounted to the bow of the boat 11 remote from the trolling motor 13 with its direction of rotation controlled by a treadle control unit 17 positionable adjacent a user of the device. A direct current battery 18 provides power for the steerage motor 16 and the trolling motor 13 in the use of an electrical trolling motor. Steerage motor electrical line 19 electrically associates the steerage motor 16 with the battery 18 by way of the treadle control unit 17 with trolling motor electrical lines 20 spliced into the lines 19 between the treadle control unit 17 and the battery 18.

Figure 2:
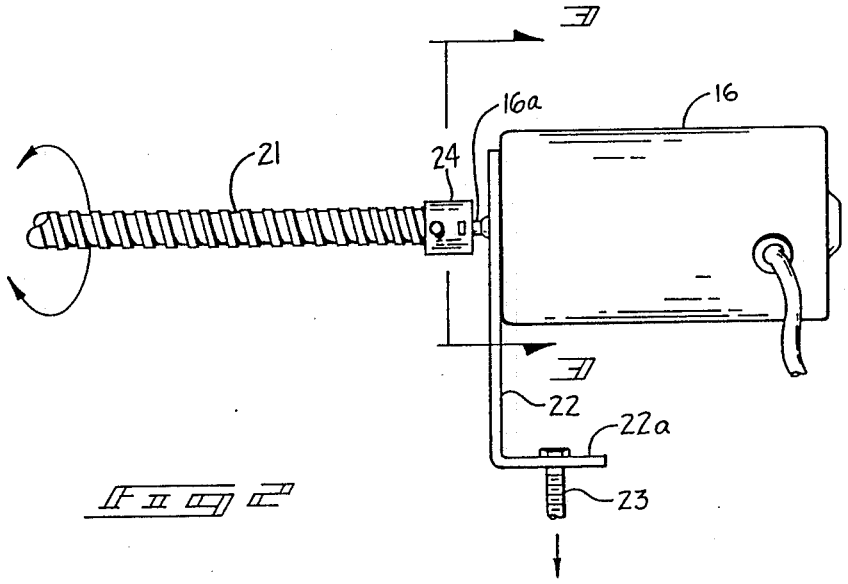
FIG. 2 is an orthographic side view taken in elevation of the electrical steerage motor and support bracket.
Figure 3:
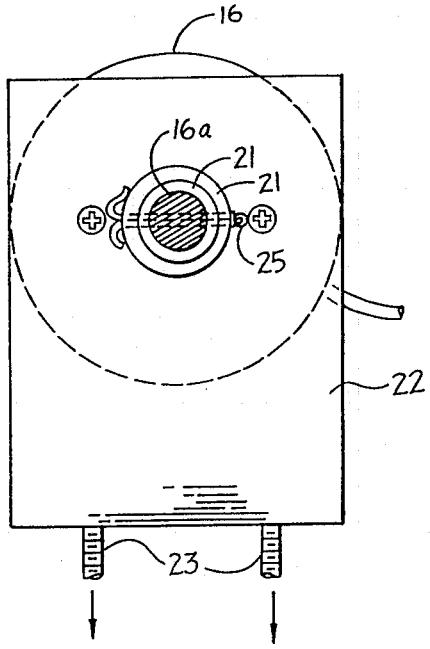
FIG. 3 is an orthographic view taken along the lines 3–3 of FIG. 2 in the direction indicated by the arrows.
Figures 4, 5:
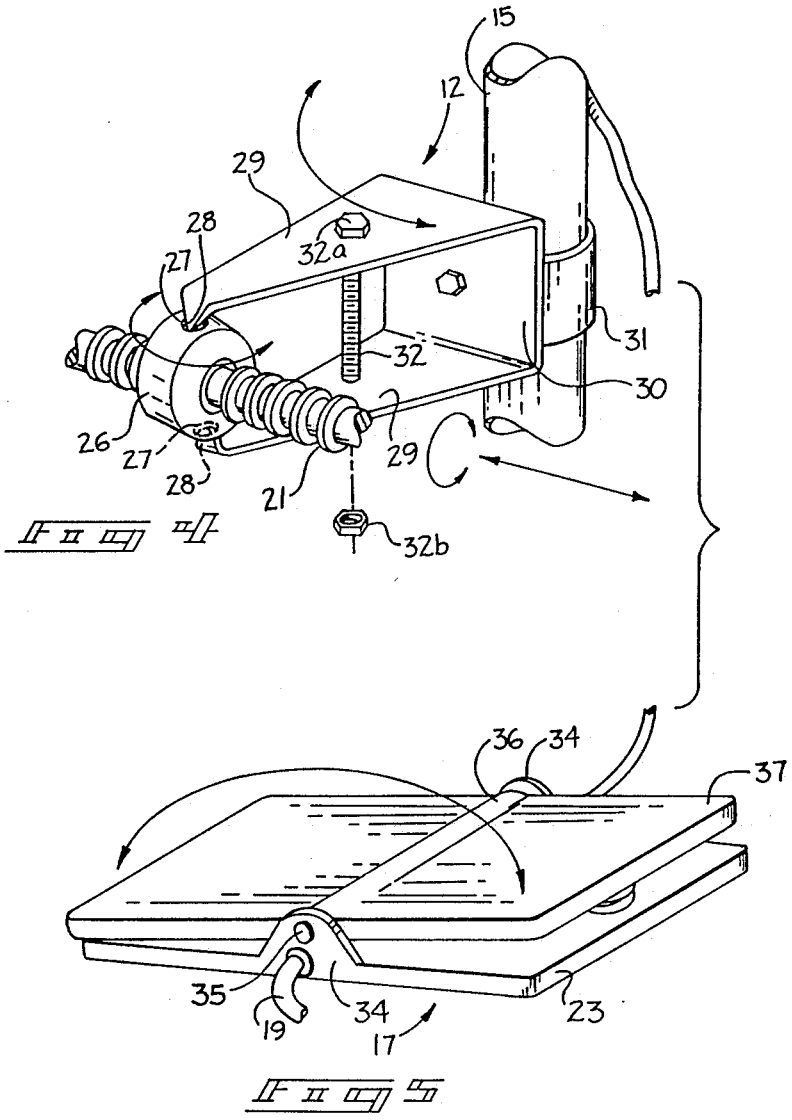
FIG. 4 is an isometric illustration of the steerage bracket of the instant invention.
FIG. 5 is an isometric illustration of the treadle control unit of the instant invention.
Figure 6:
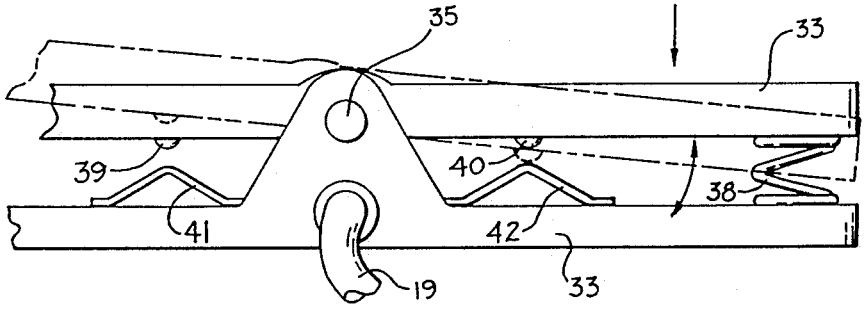
FIG. 6 is an orthographic view taken in elevation of the treadle control unit of the instant invention.
Figure 7:
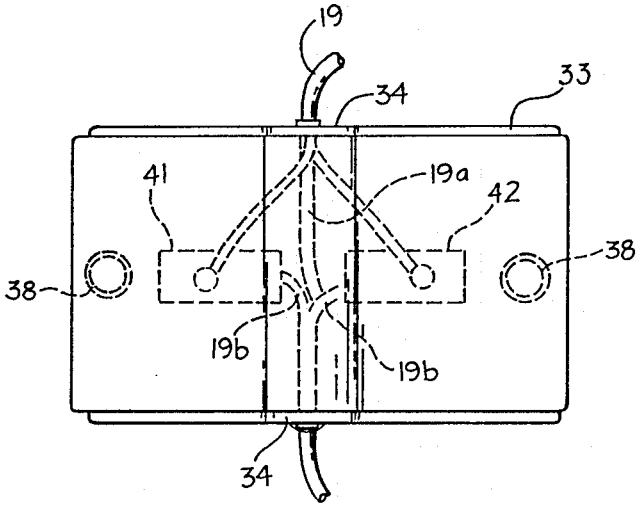
FIG. 7 is an orthographic top plan view of the treadle control unit of the instant invention.

The steerage motor 16 includes an axially extending motor shaft **16*a* extending therefrom (see FIG. 2 for example). The motor shaft 16*a* is secured to an axially extending worm gear 21 orthogonally oriented relative to the steering shaft 15 of the trolling motor 13, as well as extending beyond the steerage shaft 15, for purposes as discussed in more detail below. An "L" shaped bracket 22 is secured to a forward face of the steerage motor 16 and includes a horizontal leg 22*a* with a plurality of spaced fasteners 23 extending through the horizontal leg 22*a* and into the boat 11 to fixedlky secure the steerage motor relative to the boat. The worm gear 21 is fixedly secured at its rearwardmost end to a gear collar 24 provided with an axially aligned bore to receive the electric motor shaft 16*a* and utilizing a collar fastener 25 extending through the collar 24 and the motor shaft 16*a* to fixedly secure the worm gear 21 to the steerage motor 16. The worm gear 21 is threadedly received proximate its other end within an internally threaded collar 26 of threads complementary to that of the worm gear 21. The gear collar 26 is provided with diametrically opposed and vertically aligned blind bores 27 to pivotally receive flange tips 28 orthogonally oriented to upper and lower tapered clamp legs 29 with the tips 28 parallel to a securement web 30 integrally securing the rearwardmost ends of the clamp legs 29. The flange tips 28, the tapered clamp legs 29, and the securement web 30 comprise a steerage bracket 12 provided with a securement collar 31 extending and secured to a rear face of the securement web 30 for integral securement of the steerage bracket 12 about the steering shaft 15 of the trolling motor. An elongate tension fastener 32 extends through aligned apertures within the overlying tapered clamp legs 29 wherein the tension fastener 32 is provided with an enlarged bolt head 32*a* extending above the upper clamp leg 29 with a fastener nut 32*b* to provide adjustable tension securement of the overlying tapered clamp legs 29 and the associated flange tips 28 as they extend within the blind bores 27 of the gear collar 26**.

The treadle control unit 17 includes a planar support plate 33 of generally rectangular configuration with upwardly extending parallel ears 34 positioned medially of either side of the support plate 33 to secure a support axle 35 oriented parallel to the support plate 33 and received within a cylindrical chamber 36 medially of a treadle plate 37 that pivotally overlies the support plate 33. A plurality of spaced compression return springs 38 are sandwiched between the underlying support plate 33 and the overlying treadle plate 37 to resiliently maintain the treadle plate 37 in an initial parallel orientation relative to the support plate 33. Upon compression of either side of the treadle plate 37 about the support axle 35, a respective first or second treadle contact 39 or 40 is brought into electrical communication with a respective first or second support plate contact 41 or 42. The support plate contacts 41 and 42 are electrically associated with the electric line 19 from the DC battery 18 wherein the respective treadle contacts 39 and 40 are in electrical communication with the reversing steerage motor 16 such that upon the electrical engagement of the associated first treadle contact 39 with the first support plate contact 41 or the second treadle contact 40 with the second support plate contact 42, the direction of rotation of the steerage motor 16 is determined to rotate the worm gear 21 in either a clockwise or counter-clockwise orientation to thereby effect pivotment of the steering shaft 15 of the trolling motor 13, as desired.

As to the manner of usage and operation of the instant invention, the same should be apparent from the above description and accordingly no further discussion relative to the manner of usage and operation of the instant invention shall be provided.

With respect to the above description then it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A trolling motor foot control apparatus in combination with a trolling motor for use with a boat wherein said trolling motor includes a steering shaft pivotally mounted with respect to the boat wherein said control apparatus comprises in combination, an electrical directional reversing steerage motor including mounting means for securement of the steerage motor to the boat remote from the trolling motor further including a steerage motor output shaft, said output shaft secured to a drive gear, said drive gear operably associated with a gear collar, said gear collar mounted to a bifurcated steerage bracket, said steerage bracket mounted to said steerage shaft, and control means remotely mounted from the steerage motor and in electrical communication with the steerage motor to selectively actuate and control rotational direction of the steerage motor in a clockwise or counter-clockwise direction, and wherein the drive gear comprises an elongate worm gear extending axially of the output shaft and wherein the worm gear includes a first collar provided with an axially aligned bore relative to the output shaft and the worm gear to receive the output shaft therein, and securement means extending through the first collar and the output shaft to secure the output shaft and the worm gear together, and wherein the gear collar comprises an internally threaded collar, and further includes diametrically opposed blind bores formed through exterior surfaces of the collar and receiving within the blind bores flange tips integrally formed to the steerage bracket to pivotally mount the gear collar to the steerage bracket.

2. A trolling motor foot control apparatus as set forth in claim 1 wherein the flange tips are orthogonally secured to tapered clamp legs, said tapered clamp legs overlying one another and secured at rearward edges of the clamp legs to a securement web, and a securement collar secured to a rear face of the securement web for securement about the steering shaft of the trolling motor.

3. A trolling motor foot control apparatus as set forth in claim 2 further including a tension fastener extending orthogonally through the tapered clamp legs and including an enlarged head at one of the tension fastener to secure an upper clamp leg and a fastener nut threadedly secured to a lowermost end of a lower clamp leg to adjustably position the clamp legs relative to one another and adjust positioning of the flange tips within the diametrically opposed blind bores of the gear collar.

4. A trolling motor foot control apparatus as set forth in claim 3 wherein the worm gear of the steerage motor is aligned orthogonally relative to the steering shaft of the trolling motor.

5. A trolling motor foot control apparatus as set forth in claim 4 further including an "L" shaped bracket secured to the steerage motor at one end with a horizontally oriented leg for securement of the bracket to the boat.

6. A trolling motor foot control apparatus as set forth in claim 5 wherein the control means includes a support plate, and the support plate is formed with integral ears, the ears are oriented parallel to one another and integrally secured to opposite sides of the support plate, and further including a support axle spaced above and parallel to the support plate and mounted through the ears, and a treadle plate including a cylindrical chamber to receive the support axle therethrough, the cylindrical chamber positioned medially of the treadle plate.

7. A trolling motor foot control apparatus as set forth in claim 6 further including a plurality of compression return springs positioned on opposed sides of the support axle and captured between the treadle plate and the support plate to normally maintain the treadle plate parallel to the support plate.

8. A trolling motor foot control apparatus as set forth in claim 7 wherein the treadle plate includes a first and second treadle contact selectively and electrically communicating with a respective first and second support plate contact to selectively actuate the steerage motor in a clockwise or a counter-clockwise direction.

* * * * *